US005518201A

United States Patent [19]

Hagens et al.

[11] Patent Number: 5,518,201

[45] Date of Patent: May 21, 1996

[54] METHOD AND APPARATUS FOR PREVENTING AIR ENTRAPMENT IN A ROLLED WEB

[75] Inventors: Hajo Hagens, Wiesbaden-Auringen; Thomas Heusel; Stefan Sinzig, both of Wiesbaden; Wolfgang Oberhausen, Mainz; Reinhard Kober, Eltville, all of Germany

[73] Assignee: Hoechst Aktiengesellschaft, Frankfurt am Main, Germany

[21] Appl. No.: 387,377

[22] Filed: Feb. 13, 1995

Related U.S. Application Data

[63] Continuation of Ser. No. 957,560, Oct. 8, 1992, abandoned, which is a continuation-in-part of Ser. No. 592,697, Oct. 3, 1990, abandoned.

[30] Foreign Application Priority Data

Oct. 3, 1989 [DE] Germany ..... 39 32 934.8

[51] Int. Cl.[6] ..... B65H 18/26

[52] U.S. Cl. ..... 242/547

[58] Field of Search ..... 242/67.1, 65, 75.1, 242/55, 66, 547

[56] References Cited

U.S. PATENT DOCUMENTS

| | | | |
|---|---|---|---|
| 3,692,252 | 9/1972 | Perconti . | |
| 4,180,216 | 12/1979 | Dahl et al. . | |
| 4,343,440 | 8/1982 | Engl . | |
| 4,491,283 | 1/1985 | Pav et al. . | |
| 4,576,344 | 3/1986 | Sasaki et al. . | |
| 4,811,915 | 3/1989 | Smith . | |
| 4,830,303 | 5/1989 | Hagens et al. . | |
| 4,832,274 | 5/1989 | Hawkins . | |
| 5,026,005 | 6/1991 | Ehrola | 242/547 |

FOREIGN PATENT DOCUMENTS

| | | | |
|---|---|---|---|
| 59-153744 | 9/1984 | Japan . | |
| 0153744 | 9/1984 | Japan | 242/55 |
| 62-244849 | 10/1987 | Japan | 242/547 |
| 2-89759 | 3/1990 | Japan | 242/547 |
| 4-165759 | 6/1992 | Japan | 242/547 |

*Primary Examiner*—John P. Darling
*Attorney, Agent, or Firm*—Foley & Lardner

[57] ABSTRACT

An air-displacement roller bears against a film roll and extends to the ends of the film roll. A film web is fed to a winding core via a contact cylinder and is wound to form the film roll. The air layers carried along by the roll and the film web are included between the particular uppermost roll plies and for the most part are pressed out of the film roll via the end faces of the latter by the air-displacement roller. Each of the two roller ends is movable via a pressure mechanism articulated on a roller holder, the air-displacement roller being pressed against the film roll with a linear force lower than 10 N/cm to higher than 0.2 N/cm.

13 Claims, 2 Drawing Sheets

METHOD AND APPARATUS FOR PREVENTING AIR ENTRAPMENT IN A ROLLED WEB

This application is a continuation of application Ser. No. 07/957,560, filed Oct. 8, 1992, now abandoned, which in turn is a continuation-in-part application of Ser. No. 07/592,697, filed Oct. 3, 1990, now abandoned.

BACKGROUND OF THE INVENTION

The invention relates to a process for winding a film web onto a winding core to form a film roll in contact with a contact cylinder, via which the film web is fed to the film roll, with the contact cylinder moving oppositely to the contact roll at the same circumferential speed. The invention also relates to a device for winding a film web.

A process of this type and a device for winding up a film web are known from DE-A1-3,710,412 and work satisfactorily, for example, for winding speeds of the film webs up to approximately 100 m/min with very thin film webs, for example 3 μm PET films (PET= polyethylene terephthalate).

In the production of films, the winding of the film web as the last step of the process assumes considerable importance, because, during this, a film web which is manufactured true to specification can be wound "incorrectly" in such a way that there can be a total loss of the film roll due to damage of the film web resulting from winding tensions which are too high.

A problem which is especially important in this respect is the phenomenon that considerable quantities of air are also included in the film roll during the winding of the film web. Some of this included air escapes from the film roll during its storage. Thereby, various defects, such as cave-ins, stretching and transverse corrugations, can occur in and on the film roll and can cause the film roll to be completely useless.

In a known device for winding sheet-like structures, the film web is fed onto a roll having a shaft which is motor-driven. The film web is pressed against the roll by means of a so-called contact roller, thus ensuring that smaller quantities of air are included than without this measure. This device is described in German Patent 3,265,570 which corresponds to U.S. Pat. No. 4,576,344. At higher winding speeds, i.e., at speeds above 100 m/min, the air-displacing effect of the contact roller is no longer sufficient to displace a sufficient quantity of air entering the roll, and therefore there has to be a compromise here between the winding parameters and the inclusion of air. The entire phenomenology of air inclusion, with special consideration of the dependence of the air inclusion on the pressing force of the contact roller against the roll and of the requisite winding tension in view of the physical properties of the film, is the subject of research and development.

It has also already been proposed to carry out the entire winding operation in a vacuum, in order thereby to solve the problem of the inclusion of air, but the high financial outlay is an obstacle to putting this proposal into practice.

OBJECTS AND SUMMARY OF THE INVENTION

The object of the invention is to improve the process of winding a film web onto a winding core to form a film roll by providing a device for winding a film web in which the quantity of included air in the finished roll is as small as possible so that the winding speed can be increased substantially and/or the necessary winding tensions reduced, whilst at the same time use will also be possible for ultra-thin films with film thicknesses down to approximately one micron.

According to a first aspect of the invention, a process for winding a film web onto a winding core to form a film roll includes the steps of rotating the winding core in a first direction, and rotating a contact cylinder in a second direction opposite to the first direction at the same circumferential speed as the winding core to feed the film web onto the winding core at a contact point. An additional step comprises exerting a linear pressure of less than 10 N/cm along a contact line of the roll extending at least over the width of the roll.

In accordance with another aspect of the invention, the step of exerting a linear pressure along a contact line comprises the step of applying a pressure along the entire width of the film roll to press air trapped between film layers out of lateral end faces of the film roll.

Another object of the invention is to provide a device for forming a roll from a film web.

In accordance with one aspect of the invention, the device includes a winding core and a rotatable contact cylinder having an axis of rotation parallel to an axis of rotation of the winding core and being adapted to rotate at the same speed as the winding core in a direction opposite to the direction of rotation of the winding core to feed the film web onto the film roll at a contact point. The device further includes air-displacement means for applying a pressure to a peripheral surface of the film roll to force air out from between layers of the film roll.

In accordance with another aspect of the invention, the air-displacement means comprises an air-displacement roller which is rotatable about an axis of rotation which is parallel to the axis of rotation of the winding core and which has a peripheral surface in contact with the film roll.

In accordance with yet another aspect of the invention, the device further includes a pressure mechanism which is mounted on a roller holder and which is connected to the air-displacement roller. The pressure mechanism generates a pressure which is transmitted to the film roll via the air-displacement roller. The pressure mechanism preferably comprises an angled-lever which is pivotable about a first joint located on the contact holder and which has first and second lever arms with the first lever arm being connected to the air-displacement cylinder, a cylinder pivotally mounted on a second joint located on the contact holder, and a piston rod extending from the cylinder and connected to the second lever arm of the lever.

In accordance with yet another aspect of the invention, the air-displacement roller comprises an axle, at least two co-axial part rollers of equal diameters, and a roller spacer disposed axially between the part rollers and having a smaller diameter than that of the part rollers.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention is explained in more detail below by means of an exemplary embodiment shown in the drawings in which.

DETAILED DESCRIPTION OF THE PREFERRED EMBODIMENTS

According to the invention, the above-stated objects are achieved in that a linear pressure lower than 10 N/cm is exerted on the film roll at least along a contact line extending over the roll width.

In an embodiment of the process, the linear pressure is selected lower than 5 N/cm and preferably lower than 2.5 N/cm. The thinner the film webs, the lower is the linear pressure.

The device for winding a film web onto a winding core to form a film roll being in contact with a contact cylinder, via which the film web is fed to the roll core, comprises the rotatable cylinder situated parallel to the axis of the film roll and running at the same circumferential speed, but oppositely to the film roll. In addition, there is provided at least one air-displacement roller which is arranged parallel to the axis of the film roll and which is in contact with the film web on the film roll.

Figure 1:
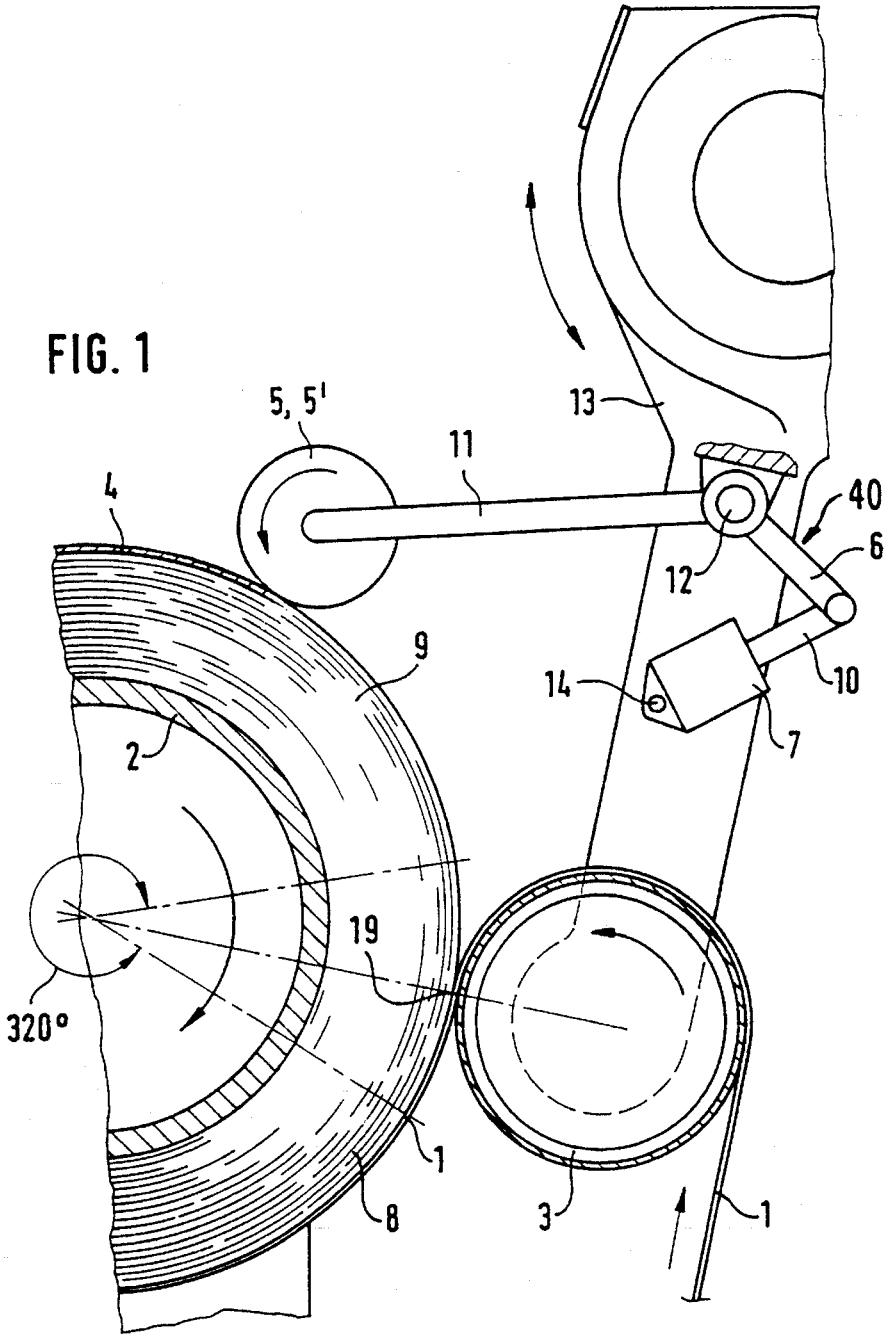
FIG. 1 shows a sectional side view of a device according to the invention.

Referring to FIG. 1, a film web 1, in order to be wound onto a winding core 2, is guided over a contact cylinder 3 which bears against a film roll 8. The film roll and the contact cylinder move oppositely to one another at the same circumferential speed. On the film web 1 fed via the contact cylinder, and on the film roll 8, there are air layers (not shown) which are included between the uppermost roll plies of the film roll.

In the device according to FIG. 1, the film web i which is guided about the contact cylinder 3, runs at a contact point 19 onto the winding core 2 or the film roll 8 and is wound onto this. That considerable quantities of air are thereby included between the uppermost roll plies of the film roll 8 can be explained by the fact that air layers adhere to the film web 1 as a result of friction, and are conveyed towards the contact point 19 by the contact cylinder.

The device makes it possible to wind ultra-thin films, such as, for example, PET films of a thickness of 2 μm, at speeds of up to approximately 300 m/min.

By means of an air-displacement roller 5 arranged parallel to the axis of the film roll 8 and pressed against the roll, the air layers 4 between the uppermost roll plies are pressed out laterally and flow off via the end faces 9 of the film roll 8. FIG. 1 shows only a single, namely the outermost air layer 4. The air-displacement roller 5 has a diameter of 10 to 100 mm and extends over and beyond the entire width of the film web, i.e. is projected beyond the end faces 9. The diameter of the roller 5 is selected to be small in comparison with the diameter of the contact cylinder 3 and of the winding core 2 or film roll 8. The roller diameter corresponds to 0.03 to 0.5 times, preferably 0.05 to 0.20 times the winding core diameter.

Figure 2:
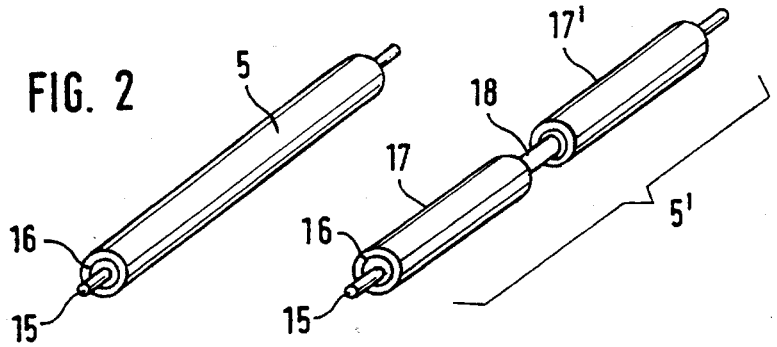
FIG. 2 shows two embodiments of rollers for the displacement of the air included between the roll plies.

The air-displacement roller 5, which is in contact with the film web 1 on the film rolls, has a smooth hard surface coating 16 (see FIG. 2).

The air-displacement roller 5 can consistently eliminate the air layers 4, without adversely influencing the winding operation, only when it is pressed with a linear pressure lower than 10 N/cm, preferably lower than 5 N/cm, to higher than 0.2 N/cm, especially 2.5 to 0.2 N/cm, against the film roll 8 rolled up on the winding core 2. This purpose is served by the device parts 6, 7, 10, 11, 12, 14 of the pressure mechanism 40 which are described below.

The roller 5 bearing against the film roll 8 is arranged movably in relation to a roller holder 13 during the entire winding operation.

Figure 3:
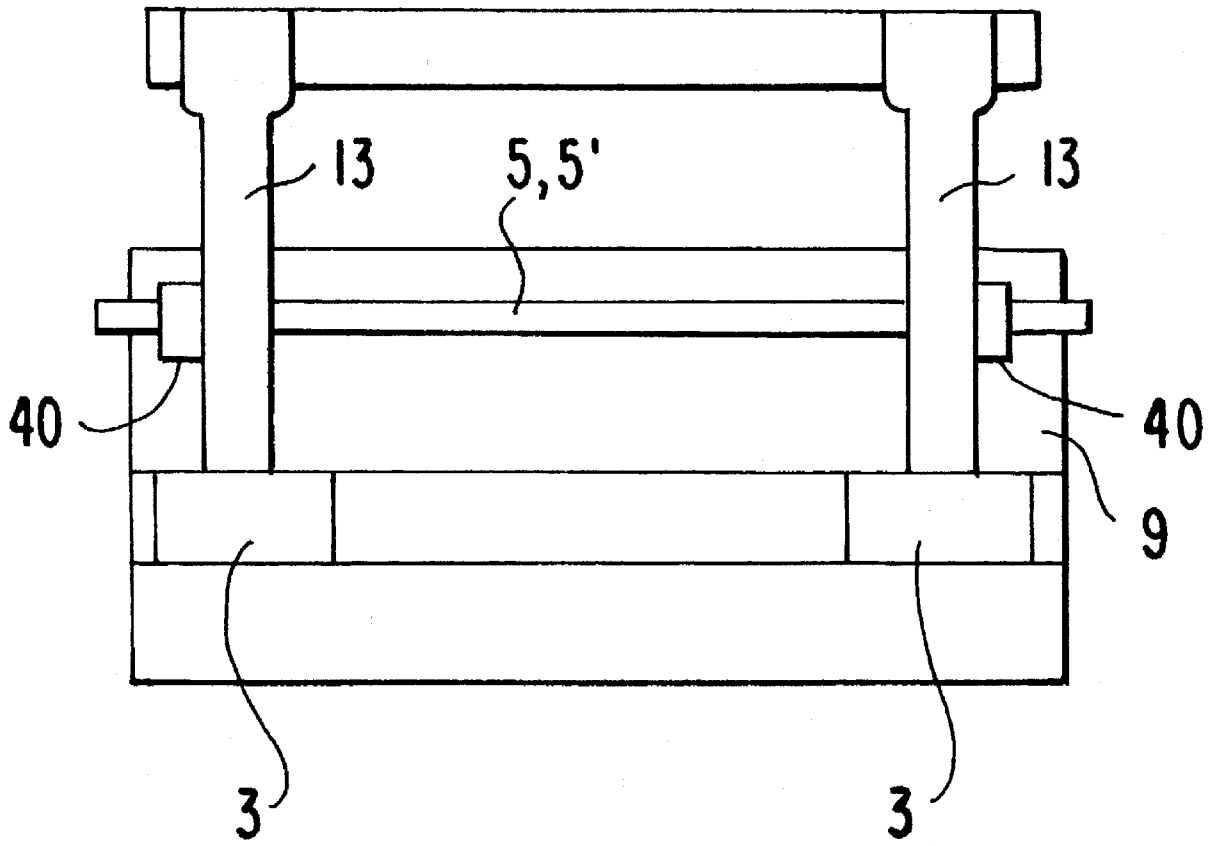
FIG. 3 shows an elevation view of a device according to the invention.

The device parts of the pressure mechanism 40 are provided in duplicate, namely for each end of the air-displacement roller 5; 5', as sown in FIG. 3. Only the device parts assigned to one end of the air-displacement roller 5; 5' are described below. The same then applies accordingly to the other end of the roller 5; 5'.

Because the roll diameter changes during the winding operation, the roller 5 bearing against the film roll 8 must be arranged movably. This is ensured by means of a cylinder 7 mounted rotatably in a joint 14, and an angle lever which is rotatably mounted in a joint 12. The angle lever includes lever arms 6, 11, of which the lever arm 6 is articulated rotatably on a piston rod 10 of the cylinder 7. These parts guide the roller 5 so that, with an increasing roll diameter, it is shifted according to the increase in diameter of the film roll.

As the roll diameter increases, the piston rod 10 retracts into the cylinder 7, with the result that the angle lever is pivoted with its lever arms 6, 11 about the joint 12 in a clockwise direction. Meanwhile, the air-displacement roller 5 is likewise raised in a clockwise direction, so that space is provided for the thickening film roll 8, or it is ensured that the air-displacement roller 5 can follow the increase of the film roll 8 and always bears against the film roll with a sufficient linear force per centimeter. The linear force per centimeter or linear pressure, respectively, changes with increasing film roll diameter within a range of between 0.2 and 10 N/cm. An increasing force is exerted by the air-displacement roller 5 against the film roll as the piston rod 10 retracts into the cylinder 7, compressing the medium contained in the cylinder 7.

The width of the film web 1 is up to 1000 mm, but wider film webs can also be wound by means of a device of this type. If, with wider film webs, the mechanical stability of the roller 5 is no longer sufficient when it is suspended only at the roller ends, another roller 5' can be used in place of a one-part roller 5, as shown in FIG. 2, having a uniform contour or constant diameter over the entire length and resting on an axle 15. The roller 5' (see FIG. 2) comprising two or more part rollers 17, 17' etc These part rollers have a uniform diameter and likewise rest on an axle 15. The mechanical load on the multipart air-displacement roller 5' can be reduced by attaching further identical device parts of the pressure mechanism to the recessed roller regions between the part rollers 17, 17', etc.

FIG. 2 shows diagrammatically the surface coatings 16 of the one-part and of the multipart roller 5 and 5'.

The roller spacer pieces 18 have a diameter smaller than the roller diameter of the part rollers 17, 17' and form a recessed roller region between two adjacent part rollers of the multipart roller 5'.

The displacement of the quantity of air included in the film roll ensures a better and longer storability of the roll. The web tension of the film web can be reduced, despite an increased film-web speed, with the result that the film web is wound with less prestress on the film roll. This reduction in web tension also contributes to an improvement of quality since, for example, fewer cave-ins and stretchings occur.

The air-displacement roller 5; 5' stems the already included air located between the uppermost roll plies. An overpressure is thereby generated immediately in front of the roller 5; 5' so that the air seeks a way out and escapes from the film roll 8 via the end faces 9 of the latter.

It has been found that the roller 5; 5' works effectively only when its diameter is smaller than 100 mm and is preferably 20 to 40 mm. In this case, even only a relatively low pressing force of the roller against the roll leads to relatively high pressures, since the roller/roll contact surface decreases in proportion to the roller radius. A small diameter of the roller 5; 5' assists the lateral escape of the included air from the roll via the end faces.

The main effect of the air-displacement roller is that air between the uppermost roll plies is forced out laterally via the end faces. It was found that the air-displacement roller can be located at any point on the roll circumference within an angular sector equal to or less than 280°, this angular sector being symmetrical to a line connecting the center of the-film roll 8 and the touch point or contact point 19 between the film roll and contact cylinder. In addition, the contact point is located outside this angular sector.

The present invention is to be distinguished from related devices such as disclosed in U.S. Pat. No. 4,830,303 to Hagens et al. In the '303 patent, the distance between the contact line of the film roll and the air displacement rollers was designed to be as short as possible. The short distance was desirable so that new air layers on the film web are quenched off very early at the beginning of their formation and therefore the new air layers are only formed very thin, so that no air or only the smallest amount of air possible is entrapped in the film roll.

In contrast to the object of the air displacement rollers of the '303 patent, the air displacement rollers 5, 5' of the present invention apply a pressure on the outermost roll plies to press out the air which has been entrapped between the plies of the film roll. This pressure is exerted along the second contact line which can be located opposite (180°) the first contact line or at any position inside the 280° angular sector. In other words, in the present invention, the air-displacement rollers are not required to be located as close as possible to the contact roller. On the other hand, in the '303 patent, the shortest distance possible between the air-displacement rollers and the first contact line must be selected to avoid the entrapment of air layers in the film roll.

The synergistic effects arising from the simultaneous use of the contact cylinder and the air-displacement roller must be stressed: the pressing force of the contact cylinder can be reduced in relation to the conventional mode of operation, since an additional means for producing "low-air" rolls is provided in the form of the air-displacement roller. The reduction of the contact cylinder pressure decreases the flexing energy in the contact region between roll and contact cylinder, so that the winding operation can be carried out with a reduced web tension. This is of essential importance especially for sensitive webs of material, such as very thin films. Comprehensive tests have demonstrated that, by means of the novel winding device constructed in accordance with the present invention, at least a doubling of the winding speed is possible for very thin PET films, without the roll firmness thereby diminishing as a result of larger quantities of included air. This is important inasmuch as a specific minimum firmness is a basic precondition for subsequent storage, without the incidence of faults, such as cave-ins, transverse creases and the like.

Of course, two or a greater number of air-displacement rollers can also be distributed over the circumference of the film roll and bear against this with correspondingly identical or different linear pressures.

The invention affords the advantages that the included air layers are displaced, the storability of the rolls is improved, and the web tension on the winding web is reduced. In addition, ultra-thin films can be wound up at a substantially increased winding speed in comparison with the previously known process, without losses in the firmness of the roll or quality losses, such as an increase in the number of creases in the roll during the roll build-up.

What is claimed is:

1. A process for winding a film web onto a winding core to form a film roll without substantial entrapment of air, said process comprising:

(A) rotating said winding core in a first direction;

(B) concurrently with rotating said winding core, rotating a contact cylinder in a second direction opposite to said first direction at the same circumferential speed as said film roll to feed said film web having a film thickness of at least 1 μm onto said film roll at a first contact line between said film roll and said contact cylinder;

(C) exerting a linear force per centimeter in the range of 0.2 N/cm to less than 10 N/cm with an air-displacement roller having a diameter between 10 and 100 mm which is between 0.03 and 0.5 times a diameter of said winding core along a second contact line of said film roll extending at least over the width of said film roll to displace air layers substantially laterally between outermost roll plies such that said air layers flow off via end faces of said film roll, said linear force exerted by said air-displacement roller against said film roll increasing within said range with increasing diameter of the film roll, said second contact line being located within an angular sector of 280° on the film roll circumference, said angular sector being symmetrical to a line connecting the center of said film roll and said first contact line between said film roll and said contact cylinder and wherein said first contact line is located outside said angular sector; and (D) projecting said air-displacement roller beyond the end faces of said film roll.

2. The process as claimed in claim 1, wherein the step of exerting a linear force per centimeter comprises the step of exerting a linear force per centimeter of between 0.2 N/cm and 5 N/cm at said second contact line between said film roll and said air-displacement roller.

3. The process as claimed in claim 2, wherein the step of exerting a linear force per centimeter comprises the step of exerting a linear force per centimeter of between 0.8 N/cm and 2.5 N/cm at said second contact line between said film roll and said air-displacement roller.

4. A device for forming a film roll without substantial entrapment of air from a film web, said device comprising:

(A) a rotatable winding core onto which said film web is wound up in a first direction to form the film roll, said film web having a thickness of at least 1 μm;

(B) a rotatable contact cylinder having an axis of rotation parallel to an axis of rotation of said winding core and being adapted to a rotate at the same circumferential speed as said film roll in a second direction opposite to the first direction of rotation of said winding core to feed said film web onto said winding core at a first contact line between said film roll and said contact cylinder;

(C) an air-displacement roller having a diameter between 10 and 100 mm, which is between 0.03 and 0.5 times a diameter of said winding core, rotatable about an axis of rotation parallel to the axis of rotation of said winding core and having a peripheral surface in contact with said film roll along a second contact line such that air layers located between outermost roll plies of said film roll are substantially displaced laterally, said air layers flowing off via end faces of said film roll, said air-displacement roller exerting a constant linear force per centimeter in the range of 0.2 N/cm to less than 10 N/cm along said second contact line, said force being equal to a diametric width of the film roll, said second contact line being located within an angular sector of 280° on the film roll circumference, said angular sector being symmetrical to a line connecting the center of said film roll and said first contact line between said film roll and said contact cylinder and wherein said first contact line is located outside said angular sector;

(D) wherein said air-displacement roller extends over the entire width of the film web and projects beyond the end faces of said film roll; and (E) a pressure mechanism which is mounted on a roller holder and which is connected to said air-displacement roller, wherein said pressure mechanism generates a force which is transmitted to said film roll along said second contact line via said air-displacement roller.

5. The device as claimed in claim 4, wherein the diameter of said air-displacement roller is between 0.05 and 0.2 times the diameter of said winding core.

6. The device as claimed in claim 4, wherein said pressure mechanism comprises:

an angled lever which is pivotable about a first joint located on said roller holder and which has first and second lever arms with the first lever arm being connected to said air-displacement roller;

a cylinder pivotally mounted on a second joint located on said roller holder; and a piston rod extending from said cylinder and connected to said second lever arm of said lever;

wherein said air-displacement roller exerts an increasing force against said film roll as said piston rod is retracted into said cylinder.

7. The device as claimed in claim 6, wherein said force per centimeter is between 0.8 and 2.5 N/cm.

8. The device as claimed in claim 6, wherein said pressure mechanism is connected to a first end of said air-displacement roller, and further comprising a second pressure mechanism connected to a second end of said air-displacement roller.

9. The device as claimed in claim 4, wherein said air-displacement roller comprises an axle, at least two co-axial part rollers of equal diameters, and a roller spacer disposed axially between said part rollers and having a smaller diameter than that of said part rollers.

10. A device for forming a film roll from a film web, said device comprising:

(A) a rotatable winding core onto which said film web is wound;

(B) a rotatable contact cylinder having an axis of rotation parallel to an axis of rotation of said winding core and being adapted to rotate at the same circumferential speed as said film roll in a direction opposite to the direction of rotation of said winding core to feed said film web onto said film roll at a first contact line; and (C) air-displacement means for applying a linearly increasing force to a peripheral surface of said film roll along a second contact line to force air out from between layers of said film roll as the diameter of the film roll increases, said second contact line being located within an angular sector of 280° on the film roll circumference, said angular sector being symmetrical to a line connecting the center of said film roll and said first contact line between said film roll and said contact cylinder and wherein said first contact line is located outside said angular sector;

(D) said air-displacement means extending over the entire width of the film web and projecting beyond end faces of said film roll.

11. The device of claim 10, wherein said air-displacement means comprises an air-displacement roller which is rotatable about an axis of rotation parallel to the axis of rotation of said winding core and which has a peripheral surface in contact with said film roll.

12. The device as claimed in claim 10, further comprising a force generating means for generating the force which is transmitted to said film roll via said air-displacement means.

13. The device as claimed in claim 12, wherein said air-displacement means comprises an air-displacement roller which is rotatable about an axis of rotation parallel to the axis of rotation of said winding core and which has a peripheral surface in contact with said film roll, and wherein said force generating means comprises:

a roller holder, an angled-lever which is pivotable about a first joint located on said roller holder and which has first and second lever arms with the first lever arm being connected to said air-displacement roller, a cylinder pivotally mounted on a second joint located on said roller holder, and a piston rod extending from said cylinder and connected to said second lever arm of said lever.

* * * * *